US012504190B2

(12) United States Patent
Mantalwad et al.

(10) Patent No.: US 12,504,190 B2
(45) Date of Patent: Dec. 23, 2025

(54) AIR CONDITIONING UNIT WITH A LEAK VENTILATION INDUCER

(71) Applicant: TRANE INTERNATIONAL INC., Davidson, NC (US)

(72) Inventors: Venkatesh Narsingrao Mantalwad, Nashville, TN (US); Scott Hall, La Crosse, WI (US); Max L. Coombs, La Crosse, WI (US); Sierra Jacobs, La Crosse, WI (US); Mel Aklile, La Crosse, WI (US); Lane A. Liudahl, Holmen, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 105 days.

(21) Appl. No.: 18/488,699

(22) Filed: Oct. 17, 2023

(65) Prior Publication Data

US 2025/0123014 A1 Apr. 17, 2025

(51) Int. Cl.

| | |
|---|---|
| ***F24F 11/36*** | (2018.01) |
| ***F24F 1/022*** | (2019.01) |
| ***F25B 49/00*** | (2006.01) |
| *F24F 11/89* | (2018.01) |

(52) U.S. Cl.

CPC ..... *F24F 11/36* (2018.01); *F25B 49/005* (2013.01); *F24F 1/022* (2013.01); *F24F 11/89* (2018.01); *F25B 2500/222* (2013.01)

(58) Field of Classification Search

CPC ..... F24F 11/36; F25B 2500/222

See application file for complete search history.

(56) References Cited

U.S. PATENT DOCUMENTS

| | | | | |
|---|---|---|---|---|
| 6,536,225 | B1 * | 3/2003 | Yajima | F24F 1/022 62/407 |
| 8,695,404 | B2 | 4/2014 | Kadle et al. | |
| 10,254,030 | B2 * | 4/2019 | Kawashima | F25B 13/00 |
| 10,539,358 | B2 | 1/2020 | Suzuki et al. | |
| 10,935,454 | B2 | 3/2021 | Kester | |
| 11,041,647 | B2 * | 6/2021 | Weinert | F24F 11/79 |
| 11,092,566 | B2 | 8/2021 | Chen et al. | |
| 11,098,915 | B2 | 8/2021 | Crawford | |
| 11,125,457 | B1 | 9/2021 | Alfano et al. | |
| 11,280,507 | B2 * | 3/2022 | Yoneyama | F24F 11/36 |
| 11,703,240 | B2 | 7/2023 | Hansen et al. | |
| 11,835,244 | B2 * | 12/2023 | Lord | F24F 11/36 |

(Continued)

*Primary Examiner* — Christopher R Zerphey
(74) *Attorney, Agent, or Firm* — HSML P.C.

(57) ABSTRACT

Methods and systems for an air conditioning unit is provided. The air conditioning unit includes a housing having a first compartment and a second compartment separated from the first compartment by a partition disposed in the housing, the housing including an air inlet and an air outlet. A refrigerant circuit includes a compressor disposed in the first compartment. An air flow path extends through the second compartment. The air flow path is arranged to route air flow from the air inlet to the air outlet, and a blower is disposed in the air flow path. A refrigerant leak detection system is configured to detect a refrigerant leak within the housing. An inducer is disposed in the housing. The inducer is configured to move air from the first compartment into the air flow path upon detection of the refrigerant leak by the refrigerant leak detection system.

18 Claims, 6 Drawing Sheets

(56) References Cited

U.S. PATENT DOCUMENTS

| | | | | |
|---|---|---|---|---|
| 2013/0098576 | A1* | 4/2013 | Fujitaka | F24F 11/46 165/11.1 |
| 2021/0108819 | A1 | 4/2021 | Chen et al. | |
| 2021/0123624 | A1 | 4/2021 | Kronstrom et al. | |
| 2021/0356154 | A1* | 11/2021 | Kobayashi | F25B 49/02 |
| 2022/0018580 | A1* | 1/2022 | Kim | F24F 11/36 |
| 2022/0252304 | A1 | 8/2022 | Green | |
| 2022/0397295 | A1 | 12/2022 | Sadanandan et al. | |
| 2023/0003404 | A1* | 1/2023 | Steen | F24F 11/0001 |
| 2023/0213254 | A1 | 7/2023 | Ma | |
| 2023/0243533 | A1 | 8/2023 | Kronstrom et al. | |
| 2023/0296286 | A1* | 9/2023 | Yajima | F24F 1/38 62/259.1 |
| 2024/0200814 | A1* | 6/2024 | Shin | F24F 11/36 |
| 2025/0003614 | A1* | 1/2025 | Alayil | F24F 11/52 |

* cited by examiner

AIR CONDITIONING UNIT WITH A LEAK VENTILATION INDUCER

FIELD

This disclosure relates to air conditioning units used in heating, ventilation, air conditioning, and refrigeration ("HVACR") systems. More particularly, this disclosure relates to such air conditioning units that include an inducer for ventilation of leaked refrigerant.

BACKGROUND

HVACR systems are generally used to heat, cool, and/or ventilate in a climate controlled space (e.g., an interior space of a commercial building or a residential building, an interior space of a refrigerated transport unit, or the like). A HVACR system can include an air conditioning unit for conditioning indoor air for providing climate control in the climate controlled space. The air conditioning unit can include several compartments for containing components of the air conditioning unit.

SUMMARY

This disclosure relates to air conditioning units used in heating, ventilation, air conditioning, and refrigeration ("HVACR") systems. More particularly, this disclosure relates to such air conditioning units that includes an inducer for ventilation of leaked refrigerant.

The air conditioning unit can be a heat pump operating in a heating mode or a cooling mode. During the cooling mode, the conditioned air in a blower compartment is cooled by a heat exchanger operating as an evaporator. The air in the compressor compartment, next to the blower compartment, can be relatively hot from the compressor generating heat by its operation and/or the first heat exchanger releasing heat by operating as a condenser. In a heating mode, the second heat exchanger, operating as a condenser, heats the air in the blower compartment, and the air in the blower compartment can have a temperature generally higher than the air in the compressor compartment. Accordingly, the blower compartment and the compressor compartment generally maintain a temperature difference in both operating modes. By restricting and controlling air flow between the compressor and blower compartments, convective heat transfer is reduced or eliminated, and the efficiency, capacity, and performance of the air conditioning unit can be improved.

To restrict and control air flow between the blower compartment and the compressor compartment, the compartments are respectively enclosed by tightly fit panels around and surround the compartments respectively, minimizing or reducing air leakage between the two compartments. The compressor compartment, having an enclosed volume herein, can further reduce noise transmission from operation of the compressor.

Refrigerant can leak from the refrigerant circuit, e.g., at the compressor, into an enclosed volume (e.g., the compressor compartment). Accumulation of leaked refrigerant can be toxic and/or flammable. Leaked refrigerant can be vented to prevent toxic or flammable level of accumulation of leaked refrigerant. For example, refrigerant having relatively low toxicity and/or flammability (e.g., A2L refrigerants) can be ventilated by mixing the air containing leaked refrigerant with the inlet air and/or supply air of the air conditioning. When mixed with return and/or supply air, leaked refrigerant is at a low concentration that is harmless and undetectable to human. Controlled ventilation of air into the blower compartment can remove leaked refrigerant, when a leak detected, while still isolating the two compartments when no leak is detected for maintaining the high efficiency of the air conditioning unit.

In an embodiment, an air conditioning unit includes a housing having a first compartment and a second compartment separated from the first compartment by a partition disposed in the housing, the housing including an air inlet and an air outlet. A refrigerant circuit includes a compressor disposed in the first compartment. An air flow path extends through the second compartment. The air flow path is arranged to route air flow from the air inlet to the air outlet. A blower is disposed in the air flow path. A refrigerant leak detection system is configured to detect a refrigerant leak within the housing; and an inducer is disposed in the housing. The inducer is configured to move air from the first compartment into the air flow path upon detection of the refrigerant leak by the refrigerant leak detection system.

In an embodiment, the inducer is disposed on the partition wall and over an opening that extends through the partition wall.

In an embodiment, the inducer is an inducer fan.

In an embodiment, the inducer is configured to move air through the partition in an activated mode.

In an embodiment, the inducer is configured to obstruct airflow through the inducer in a deactivated mode.

In an embodiment, the inducer is configured to move the air from the first compartment into the air flow path at a location in the air flow path in which the air flow path is conditioned.

In an embodiment, the air conditioning includes an air duct extending from the inducer towards the compressor for suctioning air from around the compressor into the air duct by the inducer.

In an embodiment, the leak detection system is configured to determine a concentration of refrigerant within the housing. The inducer is configured to activate in response to the concentration of refrigerant exceeding a predetermined value.

In an embodiment, the first compartment and the second compartment are enclosed by the housing and the partition.

In an embodiment, a method is directed to ventilating an air conditioning unit includes a housing having a first compartment, a second compartment separated from the first compartment by a partition disposed in the housing, an air inlet, and an air outlet; a refrigerant leak source disposed in the first compartment. The method includes routing air flow from the air inlet to the air outlet through the second compartment; obstructing air flow between the first compartment and the second compartment; and moving air in the first compartment into the air flow path for dispersing leaked refrigerant in the first compartment into the air flow path upon detecting a refrigerant leak.

In an embodiment, the method includes determining a refrigerant concentration in the first compartment exceeds a predetermined level; and activating the inducer for moving the air in the first compartment into the air flow path.

In an embodiment, the method includes, upon determining the refrigerant concentration does not exceed the predetermined level, obstructing airflow between the first compartment and the second compartment.

In an embodiment, a HVACR system is configured to provide conditioned air to a climate controlled space. The HVACR includes a refrigerant circuit including a compressor, a first exchanger, a second exchanger, and an expander fluidly connected; a housing having a first compartment containing the compressor and a second compartment containing a blower, the housing including an air inlet and an air outlet; a partition disposed in the housing, the partition separating first compartment and the second compartment; an air flow path extending through the second compartment, the air flow path being arranged to route air flow from the air inlet to the air outlet; a refrigerant leak detection system configured to detect a refrigerant leak within the housing; and an inducer disposed in the housing, the inducer is configured to move air in the first compartment into the air flow path, upon detection of the refrigerant leak by the refrigerant leak detection system.

In an embodiment, the first heat exchanger is configured to condition the air to provide the conditioned air; and the first heat exchanger is disposed in the second compartment.

In an embodiment, the inducer is an inducer fan.

In an embodiment, the second heat exchanger is disposed in the second compartment.

In an embodiment, the leak detection system is configured to determine a concentration of refrigerant within the housing and activate the inducer upon the concentration exceeding a predetermined value.

In an embodiment, the inducer is disposed on the partition wall and over an opening that extends through the partition wall.

BRIEF DESCRIPTION OF DRAWINGS

Like numbers represent like features.

DETAILED DESCRIPTION

This disclosure relates to air conditioning units used in heating, ventilation, air conditioning, and refrigeration ("HVACR") systems. More particularly, this disclosure relates to such air conditioning units that includes an inducer for ventilation of leaked refrigerant.

Figure 1:
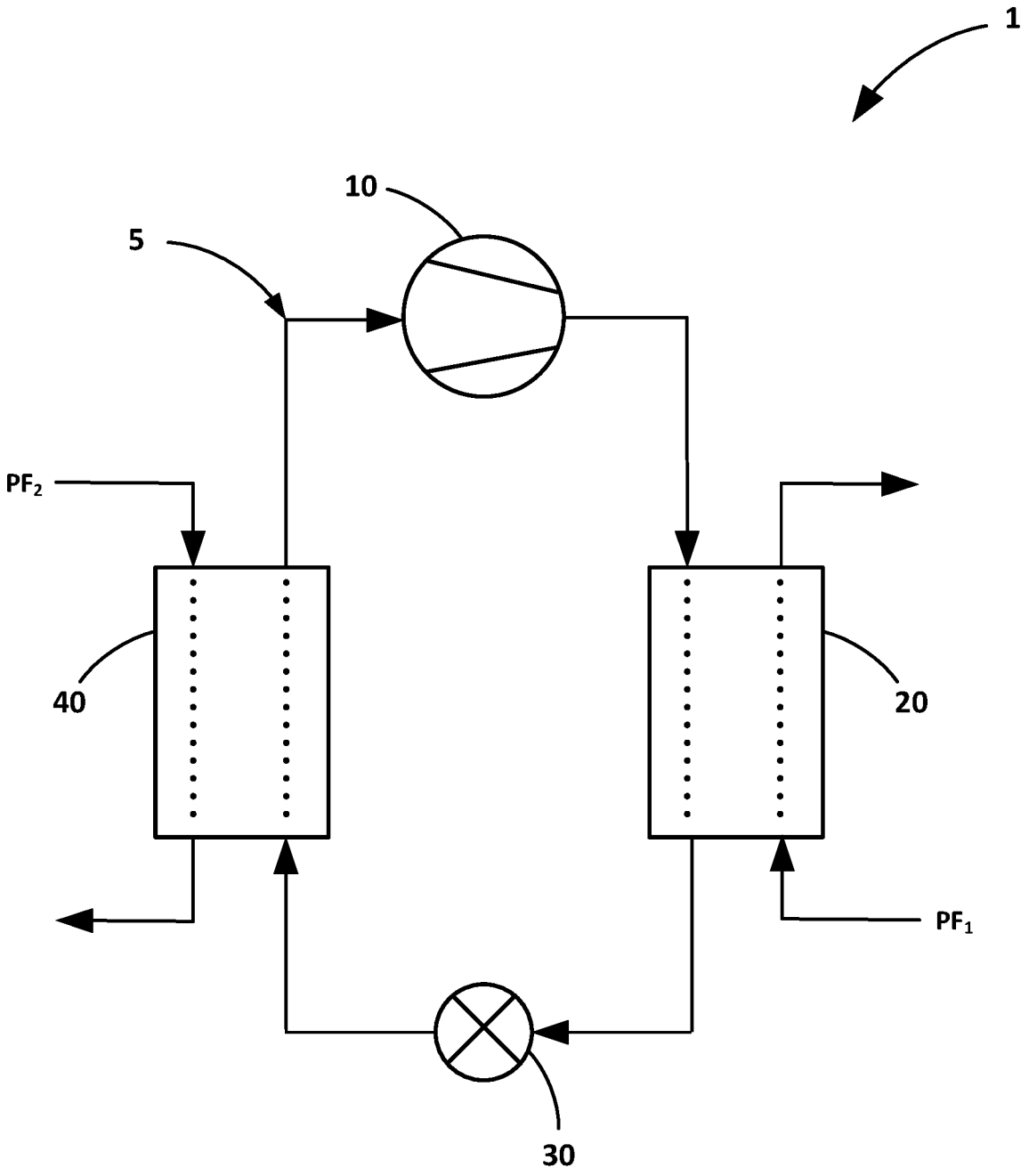
FIG. 1 is a schematic diagram of an embodiment of a refrigerant circuit of a HVACR system.

FIG. 1 is a schematic diagram of an embodiment of a refrigeration circuit 5 in a heating, ventilation, air conditioning, and refrigeration (HVACR) system 1. In an embodiment, the HVACR system 1 may be an industrial or residential HVACR system 1 configured to condition the inside of a building (e.g., office space, residential house, or the like).

The refrigeration circuit 5 includes a compressor 10, a condenser 20, an expander 30, and an evaporator 40. In an embodiment, the refrigeration circuit 5 can be modified to include additional components. For example, the refrigeration circuit 5 in an embodiment can include an economizer heat exchanger, one or more flow control devices, a receiver tank, a dryer, a suction-liquid heat exchanger, or the like. The components of the refrigerant circuit 5 are fluidly connected. Dotted lines are provided in FIG. 1 to indicate fluid flows through some components (e.g., compressor 10, condenser 20, evaporator 40) for clarity, and should be understood as not specifying a specific route within each component.

The refrigerant circuit 5 can be configured as a cooling system (e.g., a fluid chiller of an HVACR, an air conditioning system, or the like) that can be operated in a cooling mode, and/or the refrigerant circuit 5 can be configured to operate as a heat pump system that can run in a cooling mode and a heating mode.

The refrigeration circuit 5 applies known principles of gas compression and heat transfer. The refrigeration circuit can be configured to heat or cool a process fluid (e.g., water, air, chiller fluid, or the like). In an embodiment, the refrigeration circuit 5 may represent a chiller that cools a process fluid such as water or the like. In an embodiment, the refrigeration circuit 5 may represent an air conditioner and/or a heat pump that cools and/or heats a process fluid such as air, water, or the like. In an embodiment, the refrigerant circuit 5 may be a heat pump that is configured to provided heated or cooled air to the climate controlled space.

During the operation of the refrigeration circuit 5, a working fluid (e.g., containing refrigerant, refrigerant mixture, or the like) flows into the compressor 10 from the evaporator 40 in a gaseous state at a relatively lower pressure. The compressor 10 compresses the gas into a high pressure state, which also heats the gas. After being compressed, the relatively higher pressure and higher temperature gas flows from the compressor 10 to the condenser 20. In addition to the working fluid flowing through the condenser 20, a first process fluid PF1 (e.g., external air, external water, cooling water, heater water, or the like) also separately flows through the condenser 20. The first process fluid absorbs heat from the working fluid as the first process fluid PF1 flows through the condenser 20, which cools the working fluid as it flows through the condenser. The working fluid condenses to liquid and then flows into the expander 30. The expander 30 allows the working fluid to expand, which converts the working fluid to a mixed vapor and liquid state.

An "expander" as described herein may also be referred to as an expansion device. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the gaseous working fluid to decrease in pressure and temperature. The relatively lower temperature, vapor/liquid working fluid then flows into the evaporator 40. A second process fluid PF2 (e.g., air, chiller liquid, water, or the like) also flows through the evaporator 40. The working fluid absorbs heat from the second process fluid PF2 as it flows through the evaporator 40, which cools the second process fluid PF2 as it flows through the evaporator 40. As the working fluid absorbs heat, the working fluid evaporates to vapor. The working fluid then returns to the compressor 10 from the evaporator 40. The above-described process continues while the refrigeration circuit 5 is operated, for example, in a cooling mode.

Figure 2:
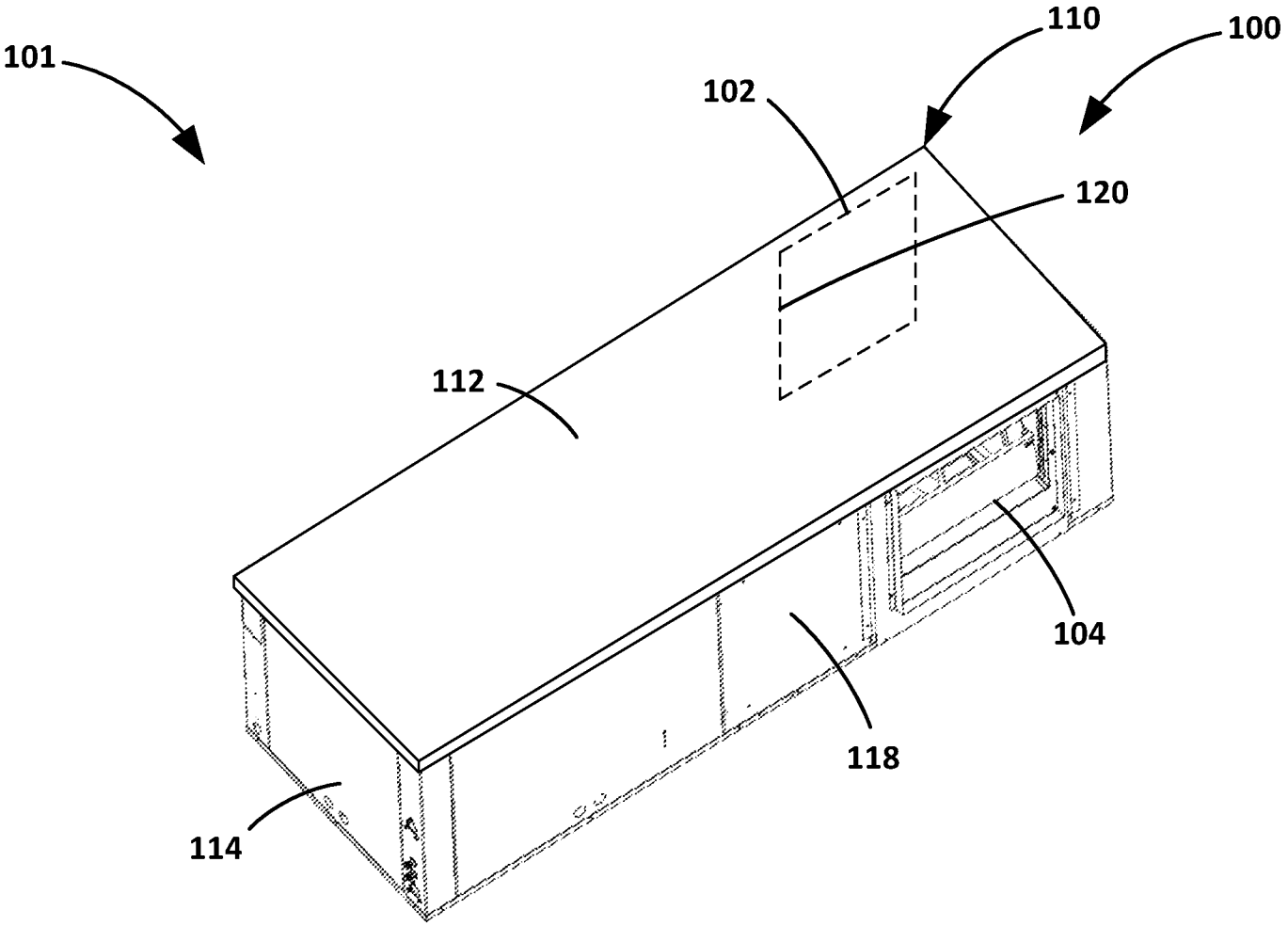
FIG. 2 is a perspective view of an embodiment of an air conditioning unit.

FIG. 2 is a perspective view of an air conditioning unit 100, according to an embodiment. In an embodiment, the air conditioning unit 100 is for a heating, ventilation, air conditioning, and refrigeration system 101.

The air conditioning unit 100 includes a housing 110 for providing structural support and/or containing components therein. The housing 110 includes a plurality of sides 112, 114, 116, 118, 120, 122 (sides 116, 120, 122 are obscured in FIG. 2). The sides may also be referred to as a top side 112, a left side 114, a right side 116, a front side 118, a rear side 120, and a bottom side 122. The components of the air conditioning unit 100 are disposed within the housing 110. In an embodiment, the housing 110 is the external housing of the air conditioning unit 100. In an embodiment, the air conditioning unit 100 may also be referred to as an air handling unit, a packaged unit, a heat pump unit, or the like.

The air conditioning unit 100 includes an inlet 102 and an outlet 104 formed in the housing 110. For example, the inlet 102 is formed in a first side 120 (e.g., rear side) of the housing 110 and the outlet 104 is formed in a second side 118 (e.g., front side) of the housing 110. Air is suctioned into the air conditioning unit 100 through the inlet 102, is conditioned (e.g., heated, cooled, or the like) within the air conditioning unit 100, and is discharged (as conditioned air) from the outlet 104. It should be appreciated that the inlet 102 and the outlet 104 may be formed in different sides 112, 116, 118, 120, 122 of the housing 110 than is shown in FIG. 3.

Figure 3:
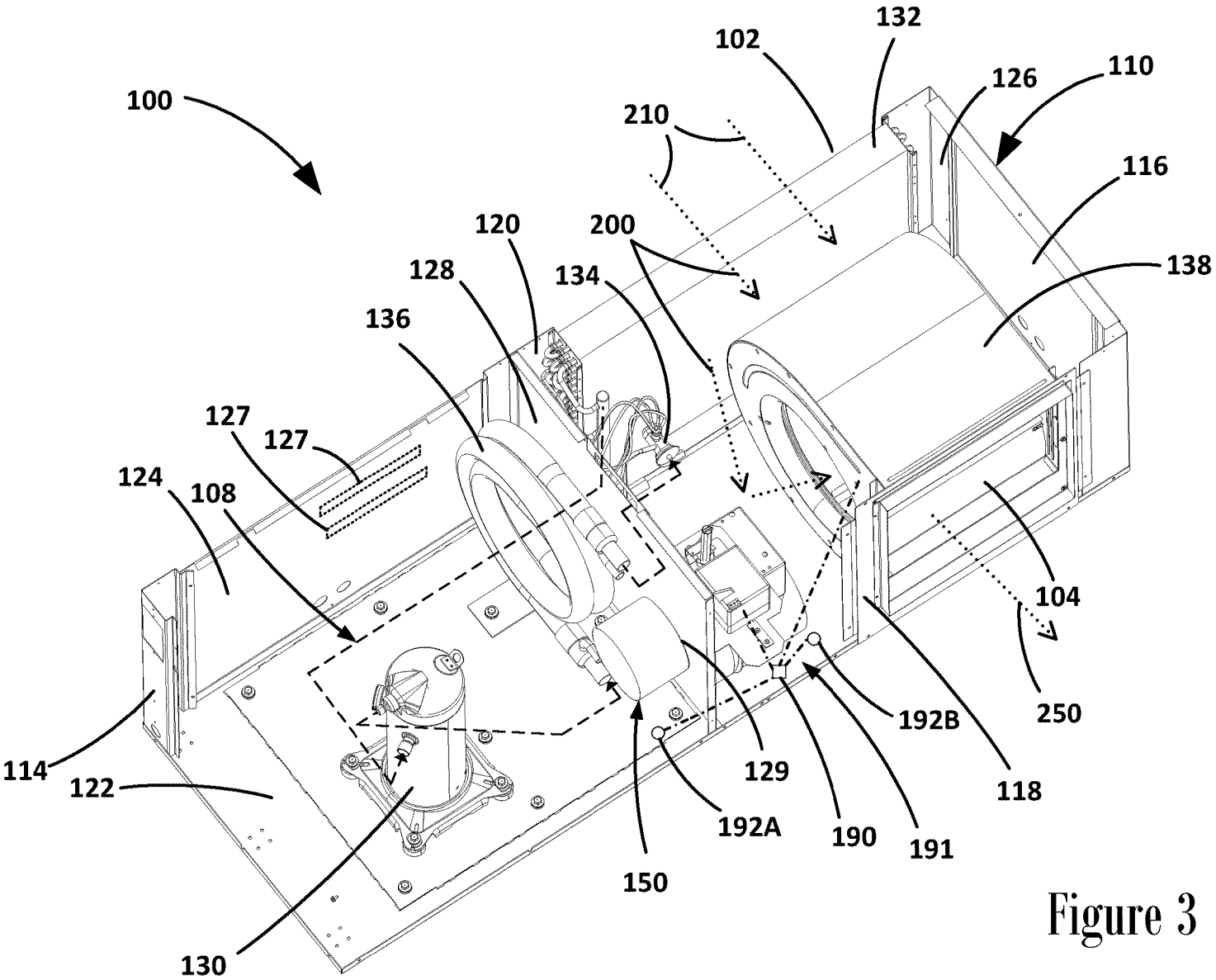
FIG. 3 is a perspective view of the air conditioning unit in FIG. 2 with the top side omitted and the left and front sides partially omitted, according to an embodiment.

FIG. 3 is a perspective view of the air conditioning unit 100 with the top side 118 omitted and the left side 114 and the front side 118 partially omitted, according to an embodiment. The air conditioning unit 100 includes a refrigerant circuit 108 that operates to provide conditioning to the air flowing through the air conditioner unit 100 (e.g., refrigerant in the refrigerant circuit 108 being used to heat and/or cool the air). For example, the refrigerant circuit 108 can be the refrigerant circuit 5 in FIG. 1. The refrigerant circuit 108 may be modified as discussed above with respect to the refrigerant circuit 5 in FIG. 1.

As shown in FIG. 3, the air conditioning unit 100 includes a compressor 130, a first heat exchanger 132, an expander 134, and a second heat exchanger 136 fluidly connected (e.g., in series). The refrigerant circuit 108 includes the compressor 130, the first heat exchanger 132, the expander 134, and the second heat exchanger 136 (e.g., are components of the refrigerant circuit 108). The compressor 130, the expander 134, the first heat exchanger 135, and the second heat exchanger 136 provide a refrigerant circuit (e.g., refrigerant circuit 5 in FIG. 1).

In an embodiment, the refrigerant circuit may be reversible (e.g., have reversing valve(s) to switch between operating in a cooling mode and a heating mode). In the cooling mode, the first heat exchanger 132 may be a heat exchanger operating as an evaporator configured to evaporate the refrigerant for cooling inlet air 210, and the second heat exchanger 136 may be a heat exchanger operating as a condenser that is configured to cool and condense (e.g., partially condense, fully condense) the refrigerant (e.g., refrigerant is cooled with water in FIG. 3). It is appreciated that the inlet air 210 may be recycled air from the climate controlled space, fresh air from outside of the climate controlled space (e.g., outdoor air), a combination thereof, or the like. In the heating mode, the first heat exchanger 132 may operate as a condenser configured to heat the inlet air 210, and the second heat exchanger 136 may operate as an evaporator. Flow of the air 210 through the housing 110 is shown in dashed arrows in FIG. 3.

Refrigerant conduits (e.g., pipes, tubes, and the like) between different components in the refrigerant circuit 108 in FIG. 3 (e.g., between the compressor 130 and the heat exchangers 132, 136, between the first heat exchanger 132 and the expander 134) are simplified as dashed arrows for illustrative purposes. The process fluid inlet and outlet conduits for the second heat exchanger 136 (e.g., to supply water to and from the second heat exchanger 136 in FIG. 3) are also omitted from FIG. 3. For example, the direction on the dashed arrows are for a flow direction when the refrigerant circuit 108 is operating in a cooling mode.

The housing 110 includes a plurality of compartments 124, 126. For example, each compartment 124, 126 is a different enclosed volume disposed within the housing 110. The compartments 124, 126 are each defined by the housing 110 (e.g., at least partially defined by the sides 112, 114, 116, 118, 120, 122 of the housing 110). As shown in FIG. 3, the housing 110 includes a first compartment 124 and a second compartment 126. The first compartment 124 is disposed adjacent to the second compartment 126.

The air conditioning unit 100 includes a partition 128 disposed within the housing 110. The first compartment 124 and the second compartment 126 are separated from each other within the housing 110 by the partition 128. As shown in FIG. 3, the second compartment 126 is adjacent to the first compartment 124. In the illustrated embodiment, the first compartment 124 and the second compartment 126 are disposed on opposite surfaces of the partition 128. It is appreciated that the housing 100 can include additional compartment(s) or volume(s) disposed therein. It should also be appreciated that the compartments 124, 126 may be further divided into smaller volumes in some embodiments.

The partition 128 is configured to restrict and control air flow from the first compartment 124 to the second compartment 126. For example, air in the first compartment 124 can be heated by the operation of the compressor 130. By restricting airflow to the second compartment, convective heat exchange between the first compartment 124 and the second compartment 126 may be reduced or eliminated. In an embodiment, the partition 128 can be configured to extend to, and/or coupled with, the sides 112, 118, 120, and 122 of the housing 110.

The first compartment 124 can be a compartment in the housing 110 that contains the compressor 130 and/or the second heat exchanger 136. In the illustrated embodiment, the first compartment 124 contains the compressor 130 (e.g., the compressor 130 is disposed within the first compartment 124) and can be referred to as a compressor compartment. In an embodiment, the first compartment 124 may be used for thermally isolating a component different from or in addition to the compressor 130 (e.g., the second heat exchanger 136, an economizer heat exchanger in the refrigerant circuit 108, or the like). As shown in FIG. 3, the second heat exchanger 136 can be also disposed in the first compartment 124. As shown in FIG. 3, the first compartment 124 can be provided/defined by the partition 128 and a plurality of the sides of the housing 110 (e.g., by the partition 128 and the sides 112, 114, 118, 120, 122).

The air conditioning unit 100 includes the blower 138 that directs air to flow through the housing 110 from the inlet 102 to outlet 104. The second compartment 126 can include the blower 138 (e.g., the blower 138 is disposed within the second compartment 126) and can be referred to as a blower compartment. As shown in FIG. 3, the first heat exchanger 132 can be disposed in the second compartment 126. As shown in FIG. 3, the second compartment 126 can be provided/defined by the partition 128 and a plurality of the sides of the housing 110 (e.g., by the partition 128 and the sides 112, 116, 118, 120, 122). The second compartment 126 can be a compartment in the housing 110 that contains an air flow path 200 for receiving and conditioning the inlet air 210 via the first heat exchanger 132 and discharging the conditioned air 250. The conditioned air 250 can be sent to the climate controlled space. In an embodiment, the second compartment 126 can be a compartment in the air conditioning unit 100 that contains the first heat exchanger 132, the blower 138, and the like.

The blower 138 is included in the air conditioning unit 100 for directing air to flow through the housing 110 via the air inlet 102 and the air outlet 104. The blower 138 is disposed in the second compartment 126. In an embodiment, the blower 138 may also direct air through a system of ductworks (not shown) for supplying the conditioned air 250 to the climate controlled space and/or suctions air (e.g., as inlet air 210) into the air conditioning unit 100 for being conditioned. The operation of the blower 138 can direct the air 210 to flow through the air flow path 200.

The blower 138 is configured to suction air into the housing 110 through the air inlet 102 and discharge the air (after being conditioned) from the housing 110 through the outlet 104. The inlet 102 and/or the outlet 104 can be openings in the housing 110. In the flow path 200, the inlet air 210 flows by passing through the first heat exchanger 132 after it flows into the housing 110 through the inlet 102. In a cooling mode, the refrigerant and the inlet air 210 exchange heat in the first heat exchanger 132 (without physically mixing) as the refrigerant and air each separately flow through the first heat exchanger 132, heating (e.g., evaporates) the refrigerant and cooling the inlet air 210. The conditioned (e.g., cooled) air then being suctioned into the blower 138 and is discharged through the outlet 104 of the air conditioning unit 100. The air inlet 102 and the air outlet 104 can be an inlet and an outlet of the second compartment 126.

As shown in FIG. 3, the second heat exchanger 136 can be disposed in the first compartment 124. A process fluid (e.g., air, water, or the like) and the refrigerant exchange thermal energy in the second heat exchanger 136, without physically mixing. In a cooling mode, the second heat exchanger 136 operates as a condenser configured to cool and condense the refrigerant from vapor to liquid phase (e.g., at least partially condense the refrigerant, fully condense the refrigerant). It is appreciated that, in the cooling mode, the refrigerant having a relatively hot temperature discharges thermal energy to the stream of air, water, or the like. In an embodiment, the thermal energy discharged from the compressor 130 can be configured to be exchanged with the stream air, water, or the like, removing the heat in the first compartment 124.

In FIG. 3, the second heat exchanger 136 is a coaxial coil heat exchanger that is configured to heat/cool (e.g., the refrigerant is cooled/heated) the refrigerant using a fluid (e.g., water, anti-freeze agent, brine, methanol, a combination thereof, or the like). It should be appreciated that the second heat exchanger 136 may be a different type of heat exchanger in other embodiments. In an embodiment, the second heat exchanger 136 may be disposed external from the air conditioning unit 100. For example, the second heat exchanger 136 may be in the form of an evaporative condenser located remote from the air conditioning unit 100 (e.g., a cooling tower that cools refrigerant from a plurality of air conditioning units, a remote air-cooled condenser, or the like).

An inducer 150 is included in the air conditioning unit 100 and configured control air flow between the first compartment 124 and the second compartment 126, as further discussed below with respect to FIG. 4.

It is appreciated that, during the cooling mode, the conditioned air in the second compartment 126 is relatively cold. The air in the first compartment 124 can be relatively hot from the compressor 130 generating heat by its operation and/or the second heat exchanger 136 releasing heat by operating as a condenser. In a cooling mode, the compressor 130 and/or the second heat exchanger 136 warm the air in the first compartment 124, such that the first compartment 124 generally has a temperature higher than that in the second compartment 126 in which the first heat exchanger 132 absorbs thermal energy cooling the air flowing therethrough. By restricting and controlling the convective heat transfer (e.g., from air flow) between the first compartment 124 and the second compartment 126, the efficiency, capacity, and performance of the air conditioning unit 100 can be improved in the heating and/or the cooling mode.

To restrict and control air flow between the first compartment 124 and the second compartment 126, the first compartment 124 and the second compartment 126 are enclosed such that panels (e.g., the housing 110, the sides, the partition 128) are fit with each forming the first compartment 124 and the second compartment 126 respectively, and air leakage between the two compartments 124, 126 is negligible. For example, the first compartment 124 may be sufficiently air tight to limit or prevent flow through an inducer 150, that is turned off, and/or the partition 128 (e.g., sufficiently air tight from the external environment, sufficiently air tight in the housing 110 along the second compartment 126). For example, when the inducer 150 in the housing 110 is turned off, a pressure drop of suctioning from the second compartment 126 causes little to no air to flow from the first compartment 124 into the second compartment 126. When the inducer 150 in the housing 110 is turned on, air is suctioned from the first compartment 124, causing air to flow from the first compartment 124 to the second compartment 126 through the opening 129 and the inducer 150 of the partition 128. The air movement between the first compartment 124 and the second compartment 126 is controlled, e.g., by turning on or off the inducer 150.

It is appreciated that leaked refrigerant is vented to prevent toxic or flammable level of accumulation of leaked refrigerant. By having enclosed first compartment 124, ventilation can be provided to reduce and eliminate the risk of toxin and/or fire. Refrigerant at a relatively low concentration can be harmless and undetectable to human such that ventilating into the second compartment 126 and venting the leaked refrigerant to the air flow path 200 and being mixed with a large volume of air can effectively remove the leaked refrigerant accumulated at the air conditioning unit 100 without detrimental effect to the users in climate controlled space.

The air conditioning unit 100 includes a refrigerant leak detection system 191. The refrigerant leak detection system 191 is configured to detect a refrigerant leak within the housing 110. The refrigerant leak detection system 191 may include one or more sensors 192A, 192B. The one or more sensor(s) 192A, 192B are leak detection sensors. Leak detection sensors may include, for example but not limited to, concentration senor(s), performance and/or operation sensor(s), or a combination thereof.

As shown in FIG. 3, the one or more sensor(s) 192A, 192B may include concentration sensor(s) configured to detect for refrigerant in the air. A concentration sensor may be configured to detect refrigerant concentration directly (e.g., by measuring refrigerant concentration in the air) or indirectly (e.g., by measuring oxygen concentration in the air, a decrease in oxygen concentration indicating a corresponding amount of refrigerant in the air).

In the illustrated embodiment, the sensor(s) 192A, 192B can be concentration sensor(s) that are configured to detect for refrigerant within the housing 110 (e.g., detect for leaked refrigerant). The concentration sensor(s) 192A, 192B include a first refrigerant sensor 192A disposed in the compressor compartment 124. The concentration sensor(s) 192A, 192B may also include a second concentration sensor 192B disposed within the blower compartment 126. In an embodiment, the one or both of the concentration sensor(s) 192A, 192B may be disposed closer to the bottom than to the top of the compressor compartment 124.

In another embodiment, the refrigerant leak detection system 191 may be configured to detect a refrigerant leak based on operation of the refrigerant circuit. For example, a decrease in the performance (e.g., efficiency) of the conditioning provided by the air conditioning system may be used to indicate a refrigerant leak. In such embodiments, the sensor(s) 192A, 192B may include one or more of performance sensor(s), temperature sensor(s), pressure sensor(s), current sensor(s), flow sensor(s), valve position sensor(s) or the like to detect performance of the conditioning of the refrigerant circuit, which can be configured to indicate a refrigerant leak.

The refrigerant leak detection system 191 may be configured to detect a refrigerant leak when the (detected) amount of refrigerant detected is above a predetermined minimum concentration (e.g., at or above a lower flammability level, or the like). The operation of the blower 138 suctions leaked refrigerant from the compressor compartment 124 into the blower compartment 126, which is then discharged from the air conditioning unit 100 through the outlet 104.

When a refrigerant leak is detected, the controller 190 turns on the inducer 150. The inducer 150 fluidly connects the first compartment 124 to the second compartment 126 and suctions the air in the first compartment that contains leaked refrigerant into the air flow path 200 for being dispersed into the conditioned air 250. The operation of the blower 138 suctions leaked refrigerant from the first compartment 124 into the second compartment 126, which is then discharged from the air conditioning unit 100 through the outlet 104. When refrigerant leak is detected, the controller 190 may also be configured to turn on the blower 138 (e.g., when the blower 138 is not currently operating).

The air conditioning unit 100 may include a controller 190 that controls operation of the inducer 150. In an embodiment, the inducer 150 can be a suction fan or the like. In an embodiment, the controller 190 may be the controller of the air conditioning unit 100. In an embodiment, the controller 190 may be the controller of the refrigerant leak detection system 191. In another embodiment, the controller may be a separate controller provided for operating the inducer 150.

A controller 190 can be included with the air conditioning unit 100 for controlling the inducer 150, operating one or more sensors 192, and/or the like. The controller 190 can be disposed on the housing 110. In an embodiment, the controller 190 may be the controller of the air conditioning unit 100. In an embodiment, the controller 190 may be a controller of the refrigerant leak detection system 191. In another embodiment, the controller may be a separate controller provided for operating the inducer 150.

The controller 190 may also be configured to maintain operation of the blower 138 and/or the inducer 150 for a predetermined time period. For example, the predetermined time period can provide ventilation to the compartments 124, 126 according to Standard UL 60335-2-40, clause GG.4 (4th Ed.).

In an embodiment, the controller 190 may also be configured to maintain operation of the blower 138 for a predetermined time period (e.g., for at least 5 minutes, for at least 10 minutes, or the like). In an embodiment, the blower 138 is maintained for the predetermined amount of time after the refrigerant concentration is (e.g., as detected via the sensor(s) 192A, 192B, by each of the sensor(s) 192A, 192B) at or below the predetermined minimum concentration.

In an embodiment, the controller 190 may also be configured to maintain operation of the inducer 150 for a predetermined time period (e.g., for at least 5 minutes, for at least 10 minutes, or the like). In an embodiment, the inducer 150 is maintained for the predetermined amount of time after the refrigerant concentration is (e.g., as detected via the sensor(s) 192A, 192B, by each of the sensor(s) 192A, 192B) at or below the predetermined minimum concentration.

The controller 190 may be configured to turn off the inducer 150 after the refrigerant is no longer detected, detected below the predetermined concentration and/or after the predetermined time period. In an embodiment, the opening 129 and/or the inducer 150 disposed on the opening 129 are relatively small such that, when the inducer is turned off, the amount of air flow through the partition 128 at the inducer 150 can be negligible. In an embodiment, the opening 129 can have a width of at or smaller than 10 inches. In an embodiment, the opening 129 can have a width of at or smaller than 6 inches. In an embodiment, the opening 129 can have a width of at or smaller than 4 inches.

In an embodiment, the housing 110 may include one or more louvers vents 127 disposed along the first compartment 124. The louver vent(s) 127 may allow air to flow into the first compartment 124 when air is being suctioned from the first compartment 124 via the inducer 150. In one example, the negative pressure caused by suctioning through the inducer 150 may cause the louver vent(s) 127 to open (e.g., to move from closed to open).

While the air conditioning unit 100 illustrated is a horizontal unit having the bottom side 122 location on a supporting structure, a floor, a roof or the like, such that the first compartment 124 and the second compartment 126 are arranged side-by-side. However, embodiments can include vertical units such that the first compartment 124 and the second compartment 126 are stacked on top of each other, or other arrangements.

Figure 4:
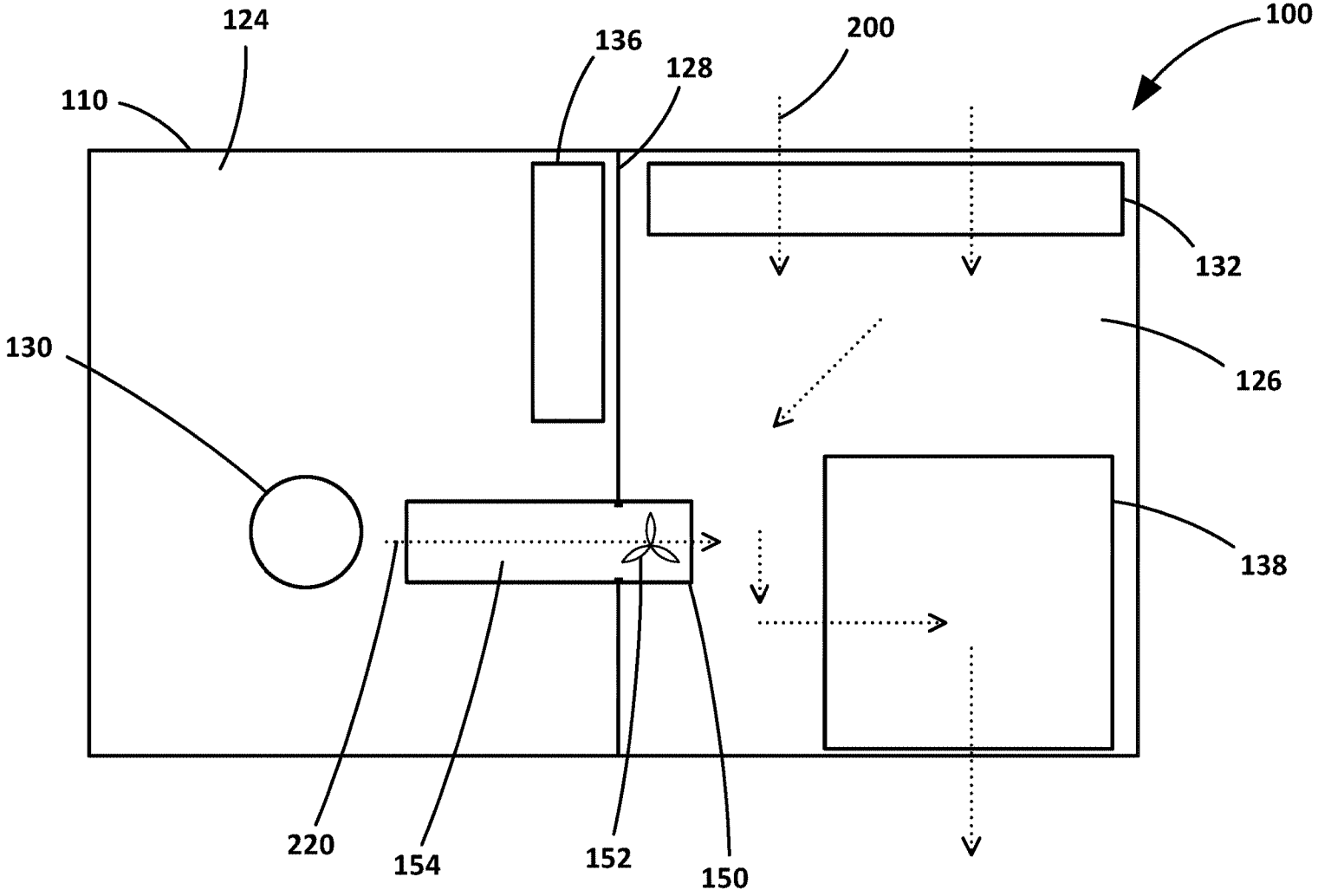
FIG. 4 is a schematic top view of the air conditioning unit in FIG. 2 with the top side omitted, according to an embodiment.

FIG. 4 is a schematic top view of the air conditioning unit in FIG. 2 with the top side omitted, according to an embodiment.

As shown in FIG. 4, the inducer 150 can be disposed on the partition 128 and attached over an opening 129 (shown in FIG. 3) on the partition 128. The inducer 150 has an activated mode and a deactivated mode. In the deactivated mode, the inducer 150 blocks/obstructs flow through the inducer 150. In an activated mode, the inducer 150 can draw air 220 to flow from the first compartment 124 and the second compartment 126 such that air 200 in the first compartment 124 is moved into the second compartment 126 to be ventilated. Air outside of the air conditioning unit 100 can be drawn through, e.g., panel gaps or louver vent 127 (shown in FIG. 3) on the housing 110 to replenish the air in the first compartment 124. In an embodiment, the inducer 150 can be an inducer fan. The inducer fan can include one or more blades 152 such that, when the inducer fan is turned on, the blades 152 spin to push air through the inducer 150. When the inducer fan is turned on, the blades 152 are stationary, obstructing air flow 220 through the inducer fan.

In an embodiment, an air duct 154 extends from the partition 128 toward a refrigerant leak source. The air duct 154 can be a channeling structure (e.g., a cylindrical or rectangular tube) having a first opening on a first end disposed on the partition 128, over the opening 129, and/or over the intake side of the inducer 150. A second end of the tubular structure of the air duct 154 is disposed at the refrigerant leak source. When the inducer 150 is turned on, the inducer 150 can suction air close to the refrigerant leak source into the air duct 154 creating an airflow 220 through the partition 128. The air close to the refrigerant leak source tends to have a higher concentration of leaked refrigerant. By including the air duct 154, the inductor 150 suctions from a location close to the refrigerant leak source and more effectively removing leaked refrigerant from the first compartment 124. In an embodiment, the refrigerant leak source is the compressor 130.

Figure 5:
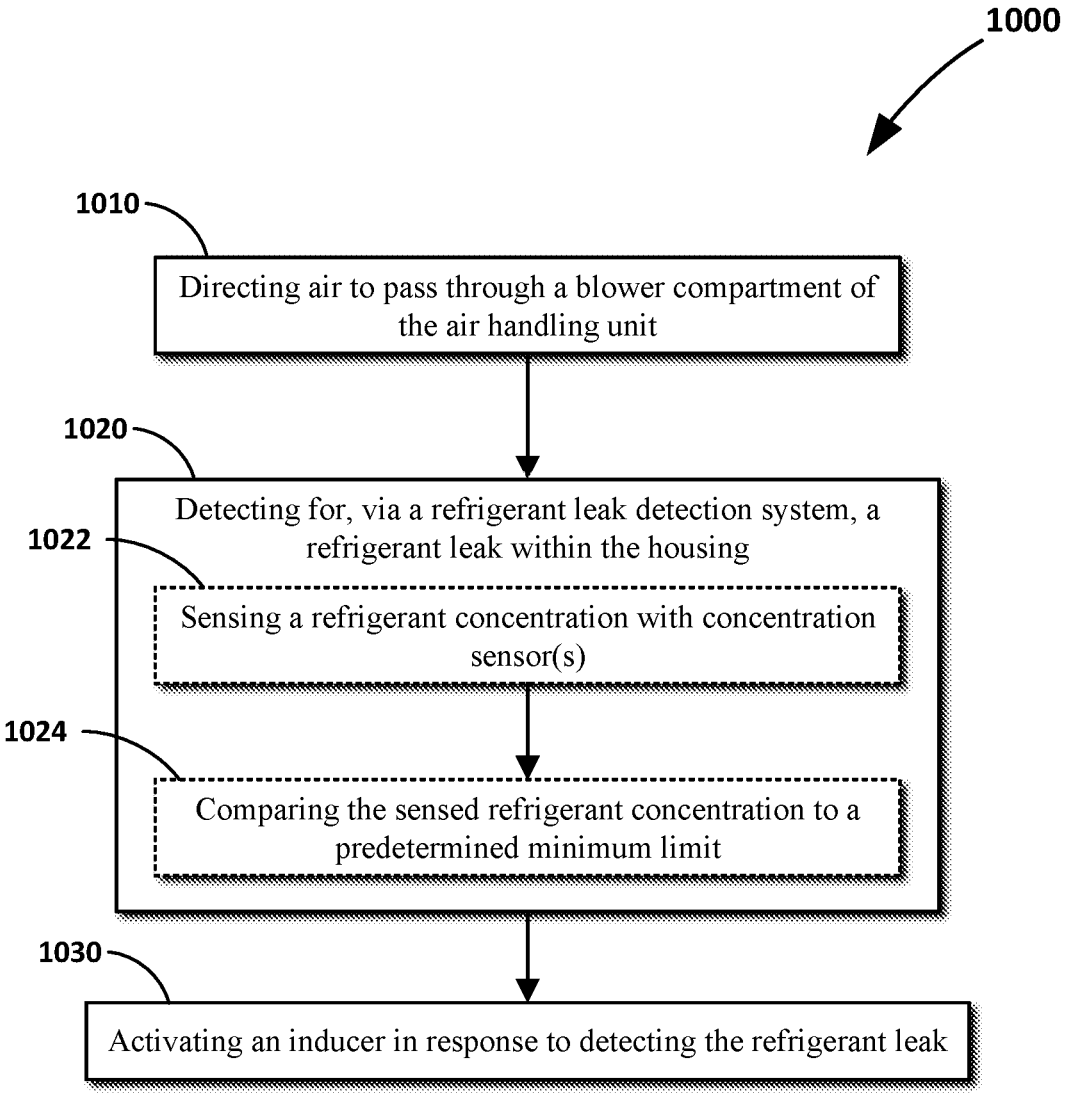
FIG. 5 is a block flow diagram for an embodiment of a method of ventilating an air conditioning unit.

FIG. 5 is a block flow diagram of a method of ventilating an air conditioning unit according to an embodiment.

For example, the method 1000 may be employed for the ventilating the air conditioning unit 100 in FIGS. 2-4. In an embodiment, the method 1000 may be employed by the controller 190 of the air conditioning unit 100. The method 1000 starts at 1010.

At 1010, air is directed to pass through a blower compartment (e.g., second compartment 126) of a housing (e.g., housing 110) of the air conditioning unit. Directing the air (e.g., inlet air 200) at 1010 can include directing the air to flow through a heat exchanger (e.g., the first heat exchanger 132) to condition the air. The air can be conditioned (e.g., heated or cooled) by refrigerant as the inlet air flows through the heat exchanger. In an embodiment, the inlet air flows into the second compartment by flowing through the heat exchanger. The method 1000 then proceeds to 1020.

At 1020, a refrigerant leak detection system (e.g., refrigerant leak detection system 1010) detects for a refrigerant within the housing of the air conditioning unit. The refrigerant leak detection at 1020 may be based on one or more of performance of the air conditioning system (e.g., detected performance of the conditioning provided by the air conditioning system), on detecting concentration of refrigerant in the air (e.g., directly or indirectly), and the like. The refrigerant leak detection system may include one or more refrigerant leak sensors (e.g., sensor(s) 192A, 192B). A refrigerant leak sensor may be, for example but not limited to, a concentration sensor, a performance sensor, or the like. For example, in an embodiment, the detecting of the leaked refrigerant at 1020 can include detecting with one or more concentration sensors a refrigerant concentration within the housing (e.g., a concentration of refrigerant in air) at 1022. In an embodiment, the sensing at 1022 can include sensing, with a concentration sensor (e.g., first sensor 192A), a refrigerant concentration in a first compartment within the housing (e.g., first compartment 124, a compressor compartment). In an embodiment, the sensing at 1022 can include sensing, with a concentration sensor (e.g., second sensor 192B) a refrigerant concentration in the second compartment (e.g., second compartment 126, the blower compartment) within the housing.

For example, in an embodiment, the detecting of the leaked refrigerant at 1020 may include detecting with one or more performance sensor(s), a performance of the air conditioning unit. Detecting the performance of the air conditioning unit may include detecting, with the one or more performance sensors, one or more operating conditions of the air conditioning unit. Operating conditions may include, but are not limited to, inlet air temperature, conditioned air discharge temperature, compressor discharge pressure, refrigerant temperature(s) (e.g., inlet and/or outlet temperature(s) of the refrigerant at one or more of the components of the refrigerant circuit 108), valve position (e.g., position of the expander 134), or the like.

The detection of a leaked refrigerant at 1020 can also include comparing the determined refrigerant concentration (e.g., detected at 1022) to a predetermined minimum limit at 1024. For example, the leaked refrigerant is detected at 1020 when a determined refrigerant concentration is at or above the predetermined minimum limit. For example, when a determined refrigerant concentration is less than the predetermined minimum limit, no leaked refrigerant is detected. The method 1000 may then proceed to 1030.

At 1030, an inducer (e.g., inducer 150) is activated in response to the detection of leaked refrigerant. The opening of the inducer at 1030 is configured to ventilate at least the first compartment within the housing.

In an embodiment, the blower (e.g., blower 138) may not be operating when leaked refrigerant is detected. In such an embodiment, the method 1030 may include activating (e.g., turning on) the blower at 1010 as a response to detecting the leaked refrigerant, in addition to or in alternative to 1010.

It should be appreciated that the method 1000 in other embodiments may be modified to include features as discussed above with respect to the air conditioning unit 100 in FIGS. 1-4. For example, the method 1000 in an embodiment may include a first mode (e.g., a heating or cooling mode) that includes 1010 for operating to heat or cool air, and a second mode that includes 1020 and 1030 for ventilating the blower compartment in response to a detected refrigerant leak (e.g., a refrigerant leak ventilation mode).

Figure 6:
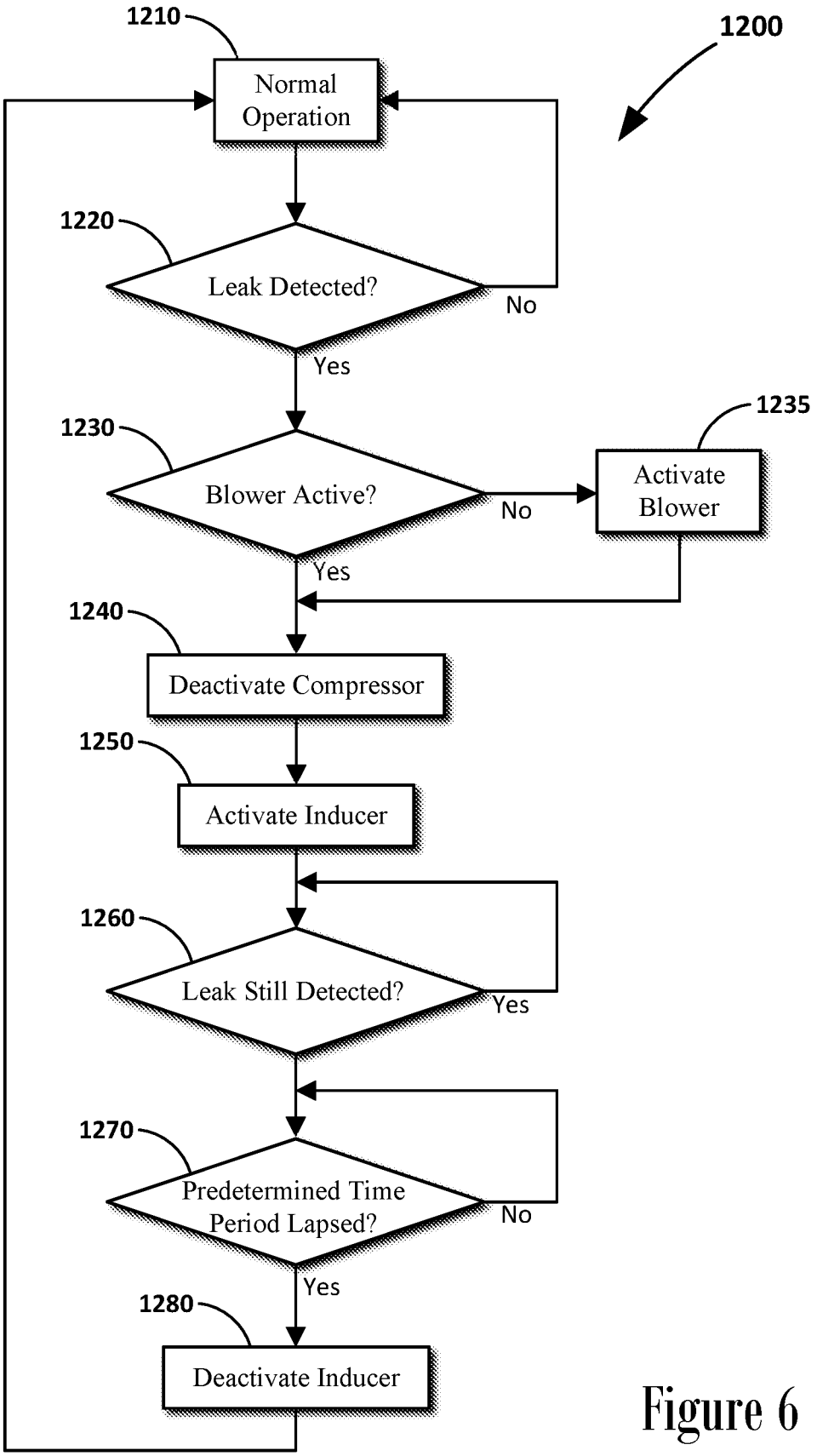
FIG. 6 is a block flow diagram for operating an air conditioning unit, according to an embodiment.

FIG. 6 is a block flow diagram of a method 1200 of ventilating an air conditioning unit. For example, the method 1200 may be employed for the ventilating the air conditioning unit 100 in FIGS. 2-4. In an embodiment, the method 1200 may be employed by the controller 190 of the air conditioning unit 100. The method 1200 starts at 1210.

At 1210, the air conditioning unit is operated normally. For example, at 1210, the operation of the air conditioning unit is not modified/changed based on detecting a refrigerant leak. Normal operation may include, for example, operating in a conditioning mode (e.g., a heating mode, a cooling mode, or the like), a ventilation mode, an off mode, or the like. In the conditioning mode, air is suctioned into the air conditioning unit, conditioned within the air conditioning unit, and the conditioned air is discharged from the air conditioning unit (e.g., as discussed for the air conditioning unit 100 in FIGS. 2-4). In a ventilation mode, air is suctioned into and then discharged from the air conditioning unit without being conditioned. In an off mode, the air conditioner is turned off (e.g., no conditioning or ventilation currently needed). The method 1200 then proceeds to 1220.

At 1220, the air conditioning unit detects for a refrigerant leak within a housing (e.g., housing 110) of the air conditioner. For example, a refrigerant detection system (e.g., refrigerant detection system 191) detects for a refrigerant leak. In an embodiment, the refrigerant leak detection 1220 in FIG. 6 may be similar to the refrigerant leak detection 1020 in FIG. 5 as discussed above. When no refrigerant leak is detected at 1220, the method 1200 proceeds back to 1210 (e.g. the air conditioning unit continues normal operation). When a refrigerant leak is detected at 1220, the method 1200 proceeds to 1230.

At 1230, when a blower (e.g., blower 138) of the air conditioning unit is not active (e.g., the blower is turned off/not currently operating), the method 1200 proceeds to 1235. At 1235, the blower is activated, and the method 1200 then proceeds to 1240. At 1230, when the blower is active (e.g., is already operating to direct air through the housing), the method 1200 proceeds from 1230 to 1240.

At 1240, a compressor (e.g., compressor 130) of the air conditioning unit is deactivated. For example, deactivating the compressor 1240 may include preventing operation of the compressor 1240 (e.g., stopping current operation, and preventing future operation while the refrigerant leak is still detected). For example, deactivating the compressor 1240 may include no longer supplying electrical power to the compressor 1240. The method 1200 then proceeds to 1250. At 1250, an inducer (e.g., inducer 150) of the air conditioning unit is activated (e.g., turned on, put in the activated mode). In an embodiment, activating of the inducer at 1250 in FIG. 6 may be similar to the activating of the inducer at 1030 in FIG. 5 as discussed above. The method 1200 then proceeds to 1260.

At 1260, the air conditioning unit detects for the refrigerant leak. For example, at 1260, the it is determined whether the housing has been ventilated such that the refrigerant leak is no longer detected. In an embodiment, the detection of the refrigerant leak at 1260 may be a continuation of the same refrigerant leak detection performed at 1220 (e.g., the refrigerant leak detection continues concurrently with 1230-1250). When the refrigerant leak is still detected at 1260, the method 1200 continues its detecting at 1260. When the refrigerant leak is not detected at 1260, the method 1200 proceeds to 1270. For example, the method 1000 does not proceed from 1260 to 1270 until the refrigerant leak is no longer detected.

At 1270, after a predetermined time period has occurred since not detecting a refrigerant leak, the method 1200 proceeds to 1280. In an embodiment, if a refrigerant leak is detected during the time period at 1270 (after detecting no refrigerant leak), the method 1200 can proceed back to 1260.

At 1280, the inducer is deactivated (e.g., turned off, put in the deactivated mode). The method 1200 then proceeds back to 1210. At 1210, the air conditioning unit is operated normally. For example, the air conditioning unit can return to operating in the same manner as previous to detecting a refrigerant leak at 1220 (e.g., previous to 1230). In an embodiment, the air conditioning unit may modify operation after the refrigerant leak is detected (e.g., proceed to a modified normal operation).

It should be appreciated that the method 1200 in FIG. 6 in other embodiments may be modified to have features as discussed herein for the air conditioning unit in FIGS. 2-4 and/or for the method 1000 in FIG. 5. It should also be appreciated that the method 1200 in FIG. 6 in other embodiments may be modified to omit or combine one or more of the blocks 1220-1280 as shown in FIG. 6.

Aspects: It is noted that any one of Aspects 1-10 below can be combined with any one of Aspects 11-18, and any one of Aspects 11-12 may be combined with any of Aspects 13-18.

Aspect 1. An air conditioning unit comprising:

a housing having a first compartment and a second compartment separated from the first compartment by a partition disposed in the housing, the housing including an air inlet and an air outlet;

a refrigerant circuit including a compressor disposed in the first compartment;

an air flow path extending through the second compartment, the air flow path being arranged to route air flow from the air inlet to the air outlet, a blower disposed in the air flow path;

a refrigerant leak detection system configured to detect a refrigerant leak within the housing; and an inducer disposed in the housing, the inducer being configured to move air from the first compartment into the air flow path upon detection of the refrigerant leak by the refrigerant leak detection system.

Aspect 2. The air conditioning unit of aspect 1, wherein the inducer is disposed on the partition wall and over an opening that extends through the partition wall.

Aspect 3. The air conditioning unit of aspect 1 or 2, wherein the inducer is an inducer fan.

Aspect 4. The air conditioning unit of any one of aspects 1-3, wherein the inducer is configured to move air through the partition in an activated mode.

Aspect 5. The air conditioning unit of any one of aspects 1-4, wherein the inducer is configured to obstruct airflow through the inducer in a deactivated mode.

Aspect 6. The air conditioning unit of any one of aspects 1-5, wherein the inducer is configured to move the air from the first compartment into the air flow path at a location in the air flow path in which the air flow path is conditioned.

Aspect 7. The air conditioning unit of any one of aspects 1-6, further comprising:

an air duct extending from the inducer towards the compressor for suctioning air from around the compressor into the air duct by the inducer.

Aspect 8. The air conditioning unit of any one of aspects 1-7, wherein the leak detection system is configured to determine a concentration of refrigerant within the housing, the inducer configured to activate in response to the concentration of refrigerant exceeding a predetermined value.

Aspect 9. The air conditioning unit of any one of aspects 1-8, wherein the first compartment and the second compartment are enclosed by the housing and the partition.

Aspect 10. A method of ventilating an air conditioning unit, wherein the air conditioning unit includes a housing having a first compartment, a second compartment separated from the first compartment by a partition disposed in the housing, an air inlet, and an air outlet; a refrigerant leak source disposed in the first compartment, the method comprising:

routing air flow from the air inlet to the air outlet through the second compartment;

obstructing air flow between the first compartment and the second compartment; and moving air in the first compartment into the air flow path for dispersing leaked refrigerant in the first compartment into the air flow path upon detecting a refrigerant leak.

Aspect 11. The method of aspect 10, further comprising determining a refrigerant concentration in the first compartment exceeds a predetermined level; and activating the inducer for moving the air in the first compartment into the air flow path.

Aspect 12. The method of aspect 11, further comprising:

upon determining the refrigerant concentration does not exceed the predetermined level, obstructing airflow between the first compartment and the second compartment.

Aspect 13. A HVACR system configured to provide conditioned air to a climate controlled space, the HVACR system comprising:

a refrigerant circuit including a compressor, a first exchanger, a second exchanger, and an expander fluidly connected;

a housing having a first compartment containing the compressor and a second compartment containing a blower, the housing including an air inlet and an air outlet;

a partition disposed in the housing, the partition separating first compartment and the second compartment;

an air flow path extending through the second compartment, the air flow path being arranged to route air flow from the air inlet to the air outlet;

a refrigerant leak detection system configured to detect a refrigerant leak within the housing; and an inducer disposed in the housing, the inducer is configured to move air in the first compartment into the air flow path, upon detection of the refrigerant leak by the refrigerant leak detection system.

Aspect 14. The HVACR system of aspect 13, wherein the first heat exchanger is configured to condition the air to provide the conditioned air; and the first heat exchanger is disposed in the second compartment.

Aspect 15. The HVACR system of aspect 13 or 14, wherein the inducer is an inducer fan.

Aspect 16. The HVACR system of any one of aspects 13-15, wherein the second heat exchanger is disposed in the second compartment.

Aspect 17. The HVACR system of any one of aspects 13-16, wherein the leak detection system is configured to determine a concentration of refrigerant within the housing, and activate the inducer upon the concentration exceeding a predetermined value.

Aspect 18. The HVACR system of any one of aspects 13-17, wherein the inducer is disposed on the partition wall and over an opening that extends through the partition wall.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. An air conditioning unit for conditioning a climate controlled space, the air conditioning unit comprising:

a housing having a first compartment and a second compartment separated from the first compartment by a partition disposed in the housing, the housing including an air inlet and an air outlet;

a refrigerant circuit including a compressor disposed in the first compartment and a first heat exchanger disposed in the second compartment;

an air flow path extending through the second compartment, the air flow path being arranged to route air to flow from the air inlet to the air outlet through the first heat exchanger, a blower disposed in the air flow path, the first heat exchanger configured to condition the air flowing through the second compartment, and the air conditioned by the first heat exchanger being provided from the air outlet to the climate controlled space;

a refrigerant leak detection system configured to detect a refrigerant leak within the housing; and an inducer disposed in the housing, the inducer being configured to move air from the first compartment into the air flow path upon detection of the refrigerant leak by the refrigerant leak detection system.

2. The air conditioning unit of claim 1, wherein the inducer is disposed on the partition and over an opening that extends through the partition.

3. The air conditioning unit of claim 1, wherein the inducer is an inducer fan.

4. The air conditioning unit of claim 1, wherein the inducer is configured to move air through the partition in an activated mode.

5. The air conditioning unit of claim 1, wherein the inducer is configured to obstruct airflow through the inducer in a deactivated mode.

6. The air conditioning unit of claim 1, wherein the inducer is configured to move the air from the first compartment into the air flow path at a location in the air flow path in which the air in the air flow path is conditioned by the first heat exchanger.

7. The air conditioning unit of claim 1, further comprising:

an air duct extending from the inducer towards the compressor for suctioning air from around the compressor into the air duct by the inducer.

8. The air conditioning unit of claim 1, wherein the refrigerant leak detection system is configured to determine a concentration of refrigerant within the housing, the inducer configured to activate in response to the concentration of refrigerant exceeding a predetermined value.

9. The air conditioning unit of claim 1, wherein the first compartment and the second compartment are enclosed by the housing and the partition.

10. The air conditioning unit of claim 1, wherein the air conditioning unit includes a cooling mode for cooling the climate controlled space, and the first heat exchanger in the cooling mode configured to operate as an evaporator that cools the air flowing through the first compartment.

11. A method of ventilating an air conditioning unit for conditioning a climate controlled space, wherein the air conditioning unit includes a housing having a first compartment, a second compartment separated from the first compartment by a partition disposed in the housing, an air inlet, and an air outlet; a refrigerant circuit including a compressor disposed in the first compartment and a first heat exchanger disposed in the second compartment; a refrigerant leak source disposed in the first compartment, the method comprising:

routing air to flow in an air flow path from the air inlet to the air outlet through the second compartment, which includes the first heat exchanger conditioning the air flowing through the second compartment, the air conditioned by the first heat exchanger being provided from the air outlet to the climate controlled space;

obstructing air flow between the first compartment and the second compartment; and moving air in the first compartment into the air flow path in the second compartment for dispersing leaked refrigerant in the first compartment into the air flow path upon detecting a refrigerant leak.

12. The method of claim 11, further comprising:

determining a refrigerant concentration in the first compartment exceeds a predetermined level; and the moving of the air in the first compartment includes activating an inducer to move the air in the first compartment into the air flow path.

13. The method of claim 12, further comprising:

upon determining the refrigerant concentration does not exceed the predetermined level, obstructing the air flow between the first compartment and the second compartment.

14. A heating, ventilation, air conditioning, and refrigeration ("HVACR") system configured to provide conditioned air to a climate controlled space, the HVACR system comprising:

a refrigerant circuit including a compressor, a first heat exchanger, a second heat exchanger, and an expander fluidly connected;

a housing having a first compartment containing the compressor and a second compartment containing a blower and the first heat exchanger, the housing including an air inlet and an air outlet;

a partition disposed in the housing, the partition separating the first compartment and the second compartment;

an air flow path extending through the second compartment, the air flow path being arranged to route air to flow from the air inlet to the air outlet, the first heat exchanger configured to condition the air flowing through the second compartment to provide the conditioned air, the air conditioned by the first heat exchanger being provided from the air outlet to the climate controlled space;

a refrigerant leak detection system configured to detect a refrigerant leak within the housing; and an inducer disposed in the housing, the inducer is configured to move air in the first compartment into the air flow path, upon detection of the refrigerant leak by the refrigerant leak detection system.

15. The HVACR system of claim 14, wherein the inducer is an inducer fan.

16. The HVACR system of claim 14, wherein the second heat exchanger is disposed in the second compartment.

17. The HVACR system of claim 14, wherein the refrigerant leak detection system is configured to determine a concentration of refrigerant within the housing, and activate the inducer upon the concentration exceeding a predetermined value.

18. The HVACR system of claim 14, wherein the inducer is disposed on the partition and over an opening that extends through the partition.

* * * * *